United States Patent [19]

Champ

[11] Patent Number: 4,700,832

[45] Date of Patent: Oct. 20, 1987

[54] PACKING BRACE WITH INTERLOCKING MEMBERS

[75] Inventor: David M. Champ, Pawcatuck, Conn.

[73] Assignee: United Foam Plastics Corp., Georgetown, Mass.

[21] Appl. No.: 912,981

[22] Filed: Sep. 29, 1986

[51] Int. Cl.[4] ..... B65D 81/06

[52] U.S. Cl. ..... 206/320; 68/3 R; 206/523

[58] Field of Search ..... 206/320, 523, 493, 437, 206/588, 591, 592; 68/3 R

[56] References Cited

U.S. PATENT DOCUMENTS

| | | | |
|---|---|---|---|
| 2,961,141 | 11/1960 | Lukes . | |
| 3,620,365 | 11/1971 | Elwell . | |
| 3,809,232 | 5/1974 | Kennington | 206/320 |
| 3,812,959 | 5/1974 | Brennan | 206/320 |
| 3,901,385 | 8/1975 | Rosen et al. | 206/320 |
| 3,904,039 | 9/1975 | Anyon | 206/320 |
| 3,912,076 | 10/1975 | Elwell | 206/320 |
| 3,913,736 | 10/1975 | Brennan | 206/320 |
| 3,994,433 | 11/1976 | Jenkins et al. | 206/523 X |
| 4,240,550 | 12/1980 | Collin | 206/320 |
| 4,366,902 | 1/1983 | Fanson et al. | 206/320 |

*Primary Examiner*—George E. Lowrance
*Assistant Examiner*—Bryon Gehman
*Attorney, Agent, or Firm*—Lahive & Cockfield

[57] ABSTRACT

A collapsible washing machine packing brace having three or four support arms. The support arms extend radially from a centrally disposed collar. One of the arms is formed by the interlocking engagement of two elongate members, one which carries a male latching portion and another which carries a female latching portion. The other support arms are of a unitary construction and are integral with the outer wall of the central collar.

10 Claims, 5 Drawing Figures

PACKING BRACE WITH INTERLOCKING MEMBERS

BACKGROUND OF THE INVENTION

This invention relates to packing braces used to secure a washing machine during transport. More particularly, the present invention is directed to packing braces which immobilize the agitation and spin unit of a washing machine.

Washing machines include an agitator and spin unit which comprises a basin or tub having a centrally disposed agitating spinning arm which extends upwardly from the bottom of the basin. The agitation unit is connected to a drive mechanism which enables the basin to spin and/or reciprocate. Because the agitation unit of a washing machine is typically quite fragile, it is necessary to somehow immobilize the agitation unit during transportation to protect it from damage caused from jostling and other uncontrolled movements.

U.S. Pat. No. 3,809,232 discloses a washing machine packing brace in which three radial arms are disposed about a non-continuous, circular central aperture. The brace is assembled to the operable position by pivoting the two outer sides of the block toward each other. One then disposes the central collar of the brace about the top portion of the washing machine agitation arm and allows the radial arms of the support brace to abut the washing machine housing.

U.S. Pat. No. 3,901,385 discloses a single piece, preassembled washing machine packing brace. The brace of this invention is formed by joining four elongate plastic strips in a particular configuration to form a packing brace which has four bracing arms. The '385 patent discloses constructing the brace by folding two of the strips on themselves and interposing the folded strips between the two remaining outer strips, with the outer ends of the interposed strips kept flush with the ends of the outer strips. This orientation will keep the inner folded ends of the interposed strips spaced apart from each other, and the outer strips will be kept flat. The brace of the '385 disclosure is used by forcing a continuous central aperture of the brace over the washing machine agitation arm and allowing the ends of the support arms to abut the washing machine housing.

U.S. Pat. No. 3,620,365 also discloses a washing machine packing brace in which four rectangular strips are joined together in a cross-like manner by an elastic cord. With each of the four arms of this brace spaced equally apart, the arms are inserted into the closed cavity of a washing machine to immobilize the agitation basin.

Despite the above-referenced disclosures, there remains a need for an effective washing machine brace which is easily and quickly assembled and which can be securely positioned and maintained within the washing machine agitation unit. There also remains a need for such a washing machine packing brace which is easily disassembled and conveniently stored for subsequent usage.

SUMMARY OF THE INVENTION

It is therefore an object of the present invention to provide a washing machine packing brace which may be securely engaged within the agitation unit of a washing machine to provide effective protection for the agitation unit against the impact and vibration which a washing machine may be subjected during transport. A further object of the invention is to provide such a washing machine packing device which can be easily disassembled and conveniently stored for subsequent use. Another object of the invention is to provide a washing machine packing brace which is easily and quickly secured within the washing machine agitation unit and which is of such construction and durability to be capable of repeated usage.

In a preferred embodiment, the collapsible packing brace of the present invention comprises four support arms which are radially disposed about a central, circular collar. The collar is operably disposed about the top portion of an agitation arm of a washing machine and the support arms extend radially therefrom and engage the top portion of the agitator basin and the washing machine housing thereby immobilizing the agitation unit. The support arms of present packing brace are equally spaced apart. Three of the support arms of the present invention are of unitary construction and are integral with the central collar. Each of the unitary support arms contains a centrally disposed, elongate, v-shaped slit. Each slit begins at a location slightly inward of the outer end of the support arm and extends to the collar. The fourth support arm (or latch arm) is formed by the positive, interlocking engagement of two elongate members, one of which has a female latching mechanism and the other a male latching mechanism.

The packing brace of this invention is disassembled by disconnecting the latching engagement of the elongate elements which form the fourth arm. The elongate elements are then pivoted away from each other as the other support arms are collapsed. Fully disassembled, the brace takes the form of a generally rectangular block wherein the support arms are sandwiched between the elongate elements.

The outer periphery of the packing device features integral hinges which take the form of semi-circular grooves formed in the outer wall of the collar. The hinges are each spaced apart by one of the support arms. The hinges allow the arms to be pivoted without destroying or damaging the packing brace.

DETAILED DESCRIPTION

Figure 1:
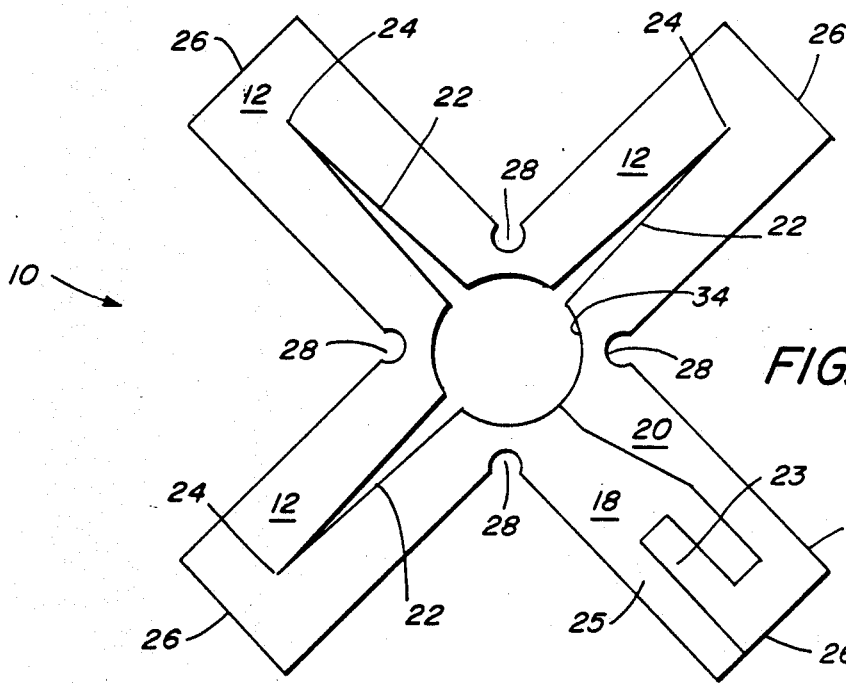
FIG. 1 is a top view of the preferred embodiment of the assembled packing brace of the present invention.

Referring to FIG. 1, which illustrates the preferred embodiment of the present invention, the packing brace 10 features three integral support arms 12 which are radially disposed about a non-continuous, central collar 14. A fourth arm 16, also radially disposed about collar 14, is formed by the interlocking engagement of female member 18 with male member 20. Centrally disposed within each of the integral support arms 12 is a v-shaped slit 22 which extends from the central collar into each of the support arms 12 and terminates in a vertex 24 slightly inward of the outer ends 26 of the support arms.

The outer periphery of the collar 14 of the packing brace 10 includes integral hinges 28 which are in the shape of semi-circles disposed in the outer wall of the collar 14. One integral hinge 28 is disposed between each of the support arms 12 and fourth interlocking arm 16.

The packing brace 10 of FIG. 1 is easily disassembled by disengaging the male 23 and female 25 portions of elongate elements 20 and 18. After disengaging male and female portions 23 and 25, cooperating elements 20 and 18 are pivoted away from each other and sandwich support arms 12, thus forming a generally rectangular block 30 as shown in FIG. 2.

Figure 2:
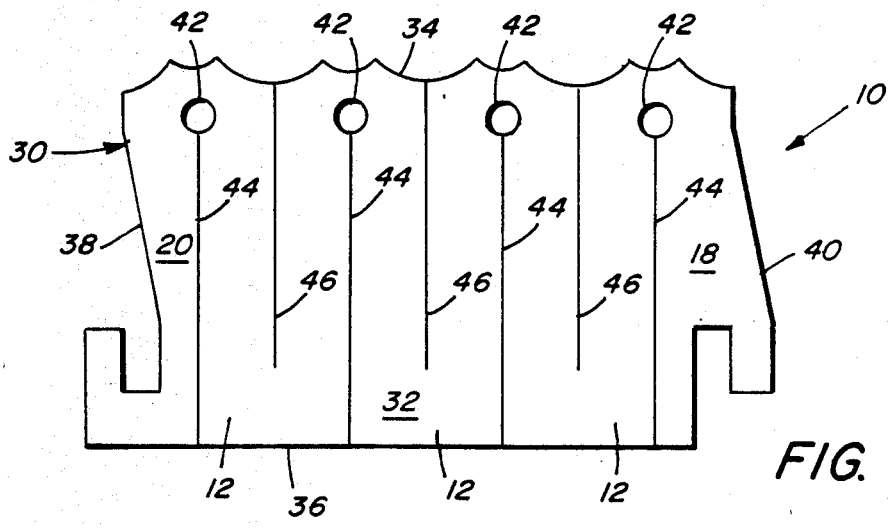
FIG. 2 is a top view of the disassembled packing brace of FIG. 1.

The disassembled form of packing brace 10, shown in FIG. 2, features a top surface 32 which is parallel to a bottom surface (not shown), and an inner, contoured side 34 which is opposite a generally flat outer side 36. The disassembled packing block 30 features opposed, cooperating sides 38 and 40 which, respectively, border elongate elements 2 and 18. The disassembled packing brace 30 also has four circular apertures 42 which, when operably disposed form hinges 28. Extending radially from each aperture 42 to outer wall 36 is a slit 44 which defines a boundary between each support arm 12 and between elements 18 and 20. Disposed between apertures 42 are equally spaced slits 46 which extend from the inner, contoured surface 34 toward the outer wall 36, terminating just inwardly from outer wall 36. In the operable position slits 46 become v-shaped slits 22.

Figure 4:
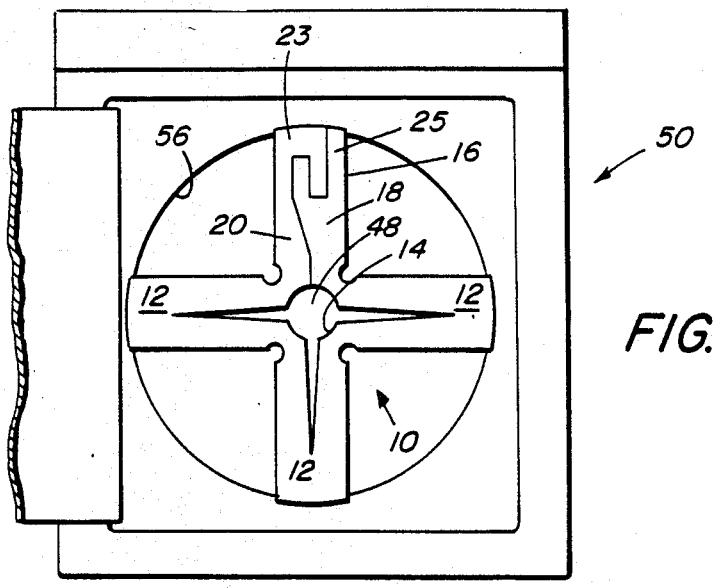
FIG. 4 is a top view of the packing brace of FIG. 1 operably disposed within a washing machine.
Figure 3:
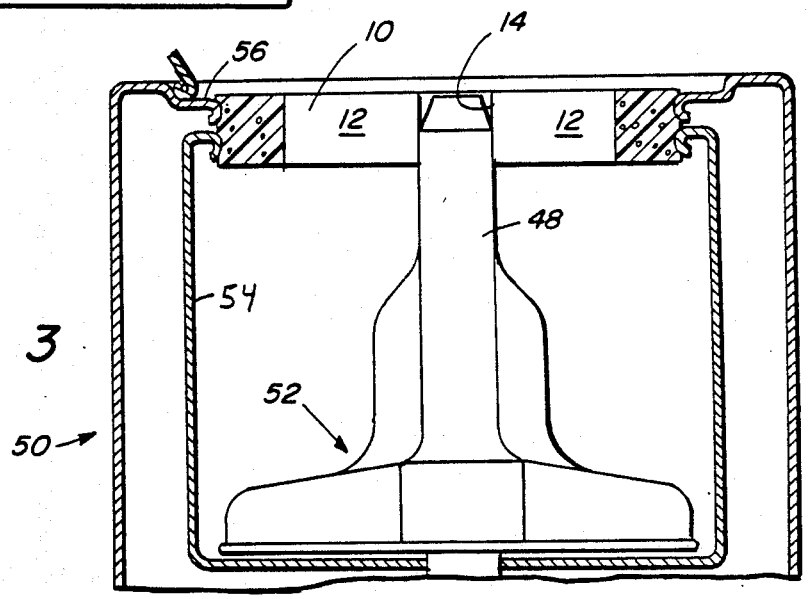
FIG. 3 is a sectional view of the packing brace of FIG. 1 operably disposed within a washing machine.

Referring to FIGS. 2 through 4, to operably dispose the packing brace 10 of the present invention, elongate members 20 and 18 of disassembled block 30 are grasped and the inner surface 34 of collar 14 is placed in contact with the upper portion of an agitator arm 48 of a washing machine 50. Elements 38 and 40 are pivoted away from each other. The packing brace 10 is arranged about the agitation unit 52 of a washing machine 50 in such a way that collar 14 surrounds the agitation arm 48 and the outer walls 26 of the support arms 12 and latching arm 16 abut the top portion of the agitation basin 54 and the washing machine housing 56. The packing brace is firmly secured by the interlocking engagement of the male 23 and female 25 portions of elements 20 and 18, thus forming latching arm 16.

Referring to FIGS. 1 and 2, when the packing brace 10 is operably disposed about the agitation unit of the washing machine, apertures 42 open to form integral hinges 28. The hinges 28 ensure that the repeated opening and closing of the packing brace and movement of arms 12 and 16 will not destroy or damage the integrity of the packing brace 10. Likewise, slits 46 of block 30 form v-shaped slits 22 in the operably disposed packing brace 10. The v-shaped slits 22 allow the packing brace to accommodate washing machine agitation arms of varying dimensions without placing undue stress on packing brace 10. Slots 22 also enable arms 12 and 16 to be compressed, to some degree, without damaging or destroying the packing brace, while efficiently absorbing vibration.

Preferably, outer walls 26 of arms 12 and 16 are flat. However, in one embodiment outer walls 26 may be tapered inward slightly from top to bottom.

In a preferred embodiment packing brace 10 is constructed of a polymer foam material such as a polyethylene foam. Other types of foamed plastics may be used. The packing brace may easily be fabricated by cutting blocks of a suitable dimension from a slab of formed polymer. The individual blocks are then tooled to form the packing brace 10 of the present invention. Using a die punching machine, or a similar apparatus, apertures 42 may be formed in desired locations of the block. The block may also be manually cut using a band saw, heated wire or similar cutting means, to form the contoured wall 34, slits 44 and 46 and the male and female portions of elements 20 and 18. It is expected that the various tooling required of a raw polymer block used to form the packing brace of the present invention may be accomplished by either manual or automated cutting means. There are thus a number of techniques which may be used to form the appropriate cuts, all of which are within the skill of those skilled in the art.

It is further understood that the dimensions of the block which is used to form the packing brace of this invention may vary depending upon the ultimate dimensions which are required for a particular application. Similarly, the dimensions of the packing brace, in its operable form, will also depend upon the application desired. However, the preferred packing brace is of the following dimensions: collar 14 to outer arm surface 26—6 11/16 inch; width of arms 12 and interlocking arm 16 —$2\frac{1}{2}$ inch; apertures 42—$\frac{7}{8}$ inch diameter; width of interlocking male and female portions 23 and 25—$\frac{1}{2}$ inch; thickness of brace—$3\frac{1}{2}$ inches.

Figure 5:
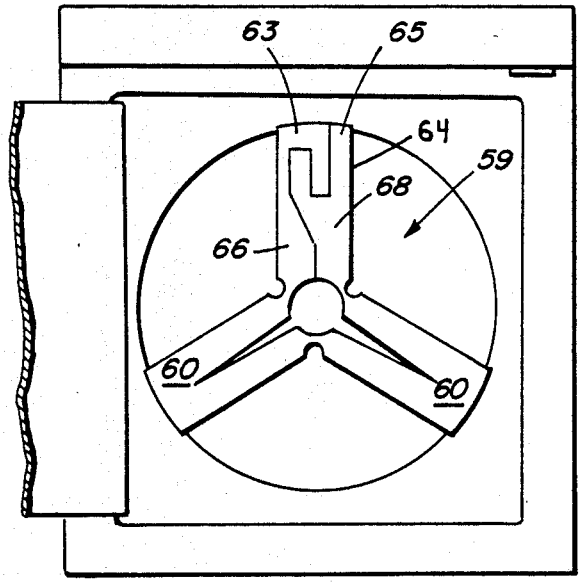
FIG. 5 is a top view of an alternate embodiment of the present invention operably disposed within a washing machine.

As shown in FIG. 5, an alternative embodiment of the present invention may feature a packing brace 59 having three arms 60, including two support arms 62 and latching arm 64. In the alternative embodiment, like the preferred embodiment, the arm 64 is formed by the latching engagement of male and female portions 63 and 65 of elongate members 66 and 68 to provide a secure, positive engagement of latching arm 64.

Having described the above invention, what is claimed is:

1. A collapsible packing brace for securing the agitator basin and agitator arm of a washing machine, comprising a generally circular non-continuous central collar;

at least two generally rectangular integral support arms, each having a unitary construction and being integral with an outer wall of said collar;

a generally rectangular latching arm extending radially from said collar, said latching arm being formed by the interlocking engagement of male and female elongate members; and a plurality of integral, semi-circular hinge means disposed on the outer wall of said brace between each of said arms.

2. The packing brace of claim 1 wherein said support arms of unitary construction include a central, v-shaped slot extending therethrough from said collar to a vertex spaced inwardly from an outer wall of said support arms.

3. The packing brace of claim 2 having two support arms.

4. The packing brace of claim 3 having three hinges.

5. The packing brace of claim 2 having three support arms.

6. The packing brace of claim 5 having four hinges.

7. The packing brace of claim 2 wherein the outer edges of said support arms and said latching arm define a generally flat surface.

8. The packing brace of claim 2 wherein the outer edges of said support arms and said latching arm define a surface tapered inwardly from top to bottom.

9. The packing brace of claim 2 wherein said brace is constructed of a polymer foam material.

10. In a washing machine brace having a centrally disposed collar and a plurality of radial support arms extending therefrom, the improvement comprising:

at least two of said support arms having a unitary construction and being integral with said collar, a latching arm formed by the interlocking positive engagement of a male portion and a female portion of cooperating elongate members wherein each of said support arms has a central, v-shaped slit extending therethrough from said collar to a vertex spaced slightly inward of an outer wall of said arms.

* * * * *